US009611802B2

(12) United States Patent
Romblom

(10) Patent No.: US 9,611,802 B2
(45) Date of Patent: Apr. 4, 2017

(54) ENGINE ASSEMBLY INCLUDING A THERMAL BARRIER

(71) Applicant: GM GLOBAL TECHNOLOGY OPERATIONS LLC, Detroit, MI (US)

(72) Inventor: Edward R. Romblom, Dewitt, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 227 days.

(21) Appl. No.: 14/499,889

(22) Filed: Sep. 29, 2014

(65) Prior Publication Data

US 2016/0090937 A1 Mar. 31, 2016

(51) Int. Cl.

| | |
|---|---|
| ***F02F 1/36*** | (2006.01) |
| ***F02F 1/14*** | (2006.01) |
| ***F02F 1/10*** | (2006.01) |
| ***F01P 5/10*** | (2006.01) |
| ***F02F 1/40*** | (2006.01) |
| ***F02F 1/24*** | (2006.01) |
| ***F02F 1/42*** | (2006.01) |
| ***F02M 53/04*** | (2006.01) |
| *F02M 61/14* | (2006.01) |
| *F02M 63/02* | (2006.01) |

(52) U.S. Cl.

CPC ..... *F02F 1/40* (2013.01); *F02F 1/14* (2013.01); *F02F 1/242* (2013.01); *F02F 1/4285* (2013.01); *F02M 53/043* (2013.01); *F01N 2260/20* (2013.01); *F02F 2001/106* (2013.01); *F02M 61/14* (2013.01); *F02M 63/0275* (2013.01); *F02M 2200/03* (2013.01)

(58) Field of Classification Search

CPC ..... F02F 1/40; F02F 61/14; F02F 63/0275; F02F 1/242; F02F 1/4285; F02F 1/14; F02F 7/0002

USPC ..... 123/294, 41.72–41.85

See application file for complete search history.

(56) References Cited

U.S. PATENT DOCUMENTS 3,353,522 A * 11/1967 Ley ..... F01P 3/16 123/41.31

3,769,948 A * 11/1973 Feichtinger ..... F02F 1/4214 123/188.14

* cited by examiner

*Primary Examiner* — Carlos A Rivera
*Assistant Examiner* — Syed O Hasan
(74) *Attorney, Agent, or Firm* — Quinn IP Law

(57) ABSTRACT

An engine assembly includes a cylinder block having at least one cylinder. The engine assembly includes at least one cylinder head coupled to the cylinder block, and at least one intake port coupled to the cylinder head, at least one exhaust port coupled to the cylinder head, and at least one fuel injector coupled to the cylinder head. The engine assembly includes a head cooling extension protruding from the cylinder head. The head cooling extension includes at least one extension wall and defines an extension cooling passageway at least partially enclosed by the at least one extension wall. The extension cooling passageway is at least partly disposed between the exhaust port and the fuel injector in order to create a thermal barrier between the fuel injector and the exhaust port when the coolant flows through the extension cooling passageway.

18 Claims, 2 Drawing Sheets

ENGINE ASSEMBLY INCLUDING A THERMAL BARRIER

TECHNICAL FIELD

The present disclosure relates to an engine assembly including a thermal barrier between the fuel injectors and the exhaust port.

BACKGROUND

Some vehicles include an engine assembly for propulsion. The engine assembly may include an internal combustion engine and a fuel injection system. The internal combustion engine includes one or more cylinders. Each cylinder defines a combustion chamber. During operation, the internal combustion engine combusts an air/fuel mixture in the combustion chamber in order to move a piston disposed in the cylinder.

SUMMARY

After combustion in the internal combustion engine, hot exhaust gases exit the combustion chamber via the exhaust port. If the fuel injector is located in close proximity to the exhaust port, heat stemming from the exhaust gases flowing through the exhaust port may be transferred to the fuel injectors. In order to maximize the efficiency of the internal combustion engine, it is useful to minimize the heat transfer between the exhaust port and the fuel injectors. To this end, the presently disclosed engine assembly includes a head cooling extension configured to minimize heat transfer from the exhaust port to the fuel injectors.

In an embodiment, the engine assembly includes a cylinder block having at least one cylinder. Each cylinder defines a combustion chamber. The engine assembly also includes at least one cylinder head coupled to the cylinder block. The engine assembly also includes at least one intake port coupled to the cylinder head. The intake port is in fluid communication with the combustion chamber. Further, the engine assembly includes at least one exhaust port coupled to the cylinder head. The exhaust port is in fluid communication with the combustion chamber. Moreover, the engine assembly includes at least one fuel injector coupled to the cylinder head. The fuel injector is configured to inject fuel directly into the combustion chamber. The engine assembly additionally includes a head cooling extension protruding from the cylinder head. The head cooling extension includes at least one extension wall and defines an extension cooling passageway at least partially enclosed by the extension walls. The extension cooling passageway is at least partly disposed between the exhaust port and the fuel injector in order to create a thermal barrier between the fuel injector and the exhaust port when the coolant flows through the extension cooling passageway. The present disclosure also relates to a vehicle including the engine assembly described above.

The above features and advantages and other features and advantages of the present teachings are readily apparent from the following detailed description of the best modes for carrying out the teachings when taken in connection with the accompanying drawings.

DETAILED DESCRIPTION

Figure 1:
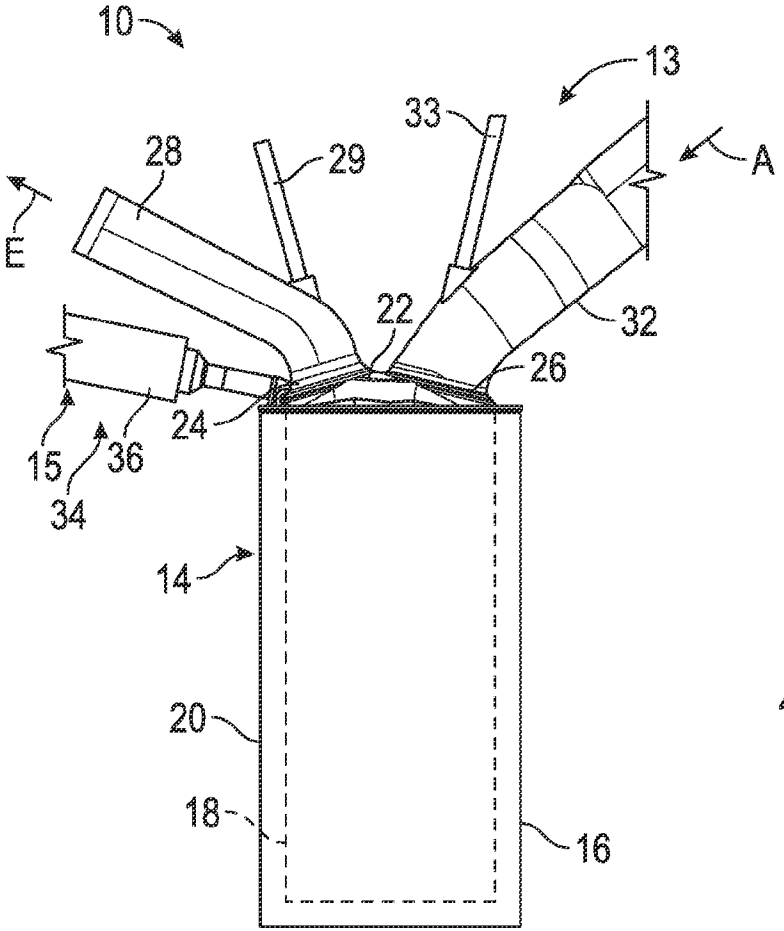
FIG. 1 is a schematic front view of an internal combustion engine, depicting a cylinder head, an exhaust port, an intake port, and a fuel injector coupled to the cylinder head adjacent to the exhaust port.

Referring to the drawings, wherein like reference numbers correspond to like or similar components throughout the several figures, and beginning with FIG. 1, an internal combustion engine 14 can be used to propel a vehicle 10 and may be part of the vehicle powertrain 13. The vehicle 10 may be an automotive vehicle, such as a car, or a non-automotive vehicle, such as a boat. To propel the vehicle 10, the internal combustion engine 14 combusts an air/fuel mixture in order to generate torque.

In the depicted embodiment, the internal combustion engine 14 includes a cylinder block 20 with at least one cylinder 16. For example, the internal combustion engine 14 may include six (6) cylinders 16 each defining a combustion chamber 18. The combustion chamber 18 is configured, shaped, and sized to receive a piston. The piston can reciprocate within the cylinder 16 when the air/fuel mixture is combusted in the combustion chamber 18.

Figure 5:
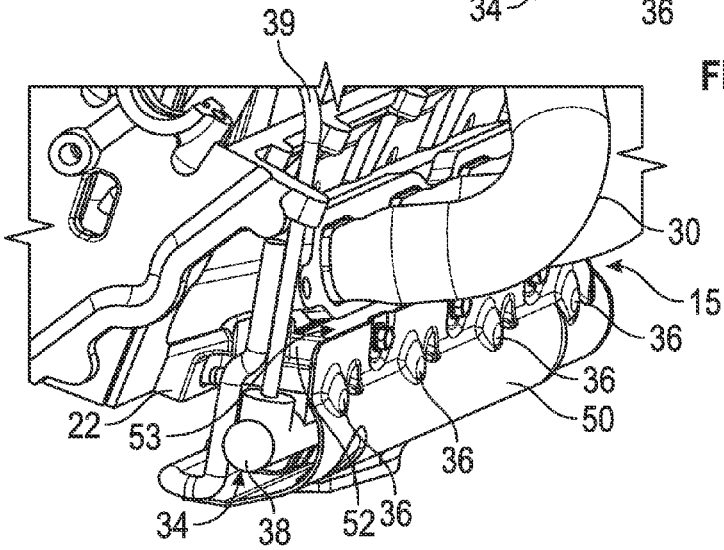
FIG. 5 is a schematic, fragmentary, perspective view of the internal combustion engine of FIG. 2, depicting the thermal barrier, the fuel injection system, a heat shield disposed partly over the fuel injection system, and an exhaust manifold coupled to the exhaust port of the internal combustion engine.

The internal combustion engine 14 further includes at least one cylinder head 22 coupled to the cylinder block 20. The cylinder head 22 has an exhaust side 24 and an intake side 26 opposite the exhaust side 24. The internal combustion engine 14 includes at least one exhaust port 28 coupled to the exhaust side 24 of the cylinder head 22. After the air/fuel mixture combusts in the combustion chamber 18, exhaust gases E can exit the combustion chamber 18 through the exhaust port 28. The exhaust port 28 is in fluid communication with the combustion chamber 18 and an exhaust manifold 30 (FIG. 5), thereby allowing the exhaust gases E in the combustion chamber 18 to flow to the exhaust manifold 30. An exhaust valve 29 is operatively coupled to the exhaust port 28 in order to control the flow of exhaust gases E through the exhaust port 28. The exhaust port 28 is defined by at least one exhaust port wall 27 (FIG. 2).

The internal combustion engine 14 further includes at least one intake port 32 coupled to the intake side 26 of the cylinder head 22. The intake port 32 is in fluid communication with the combustion chamber 18 and an intake manifold. In operation, air A can flow from the intake manifold to the combustion chamber 18 through the intake port 32. An intake valve 33 is operatively coupled to the intake port 32 in order to control the flow of air A through the intake port 32. The internal combustion engine 14 is part of an engine assembly 15.

Figure 2:
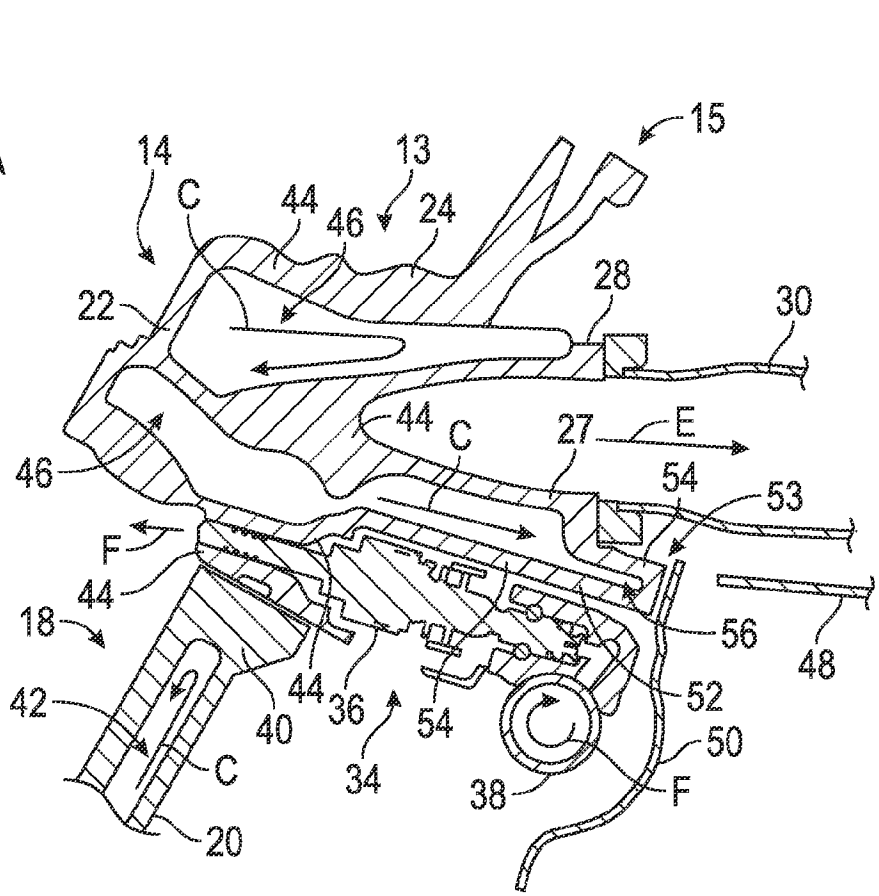
FIG. 2 is a schematic front, fragmentary cross-sectional view of the internal combustion engine of FIG. 1, depicting a thermal barrier disposed between a fuel injector and an exhaust port of the internal combustion engine.
Figure 3:
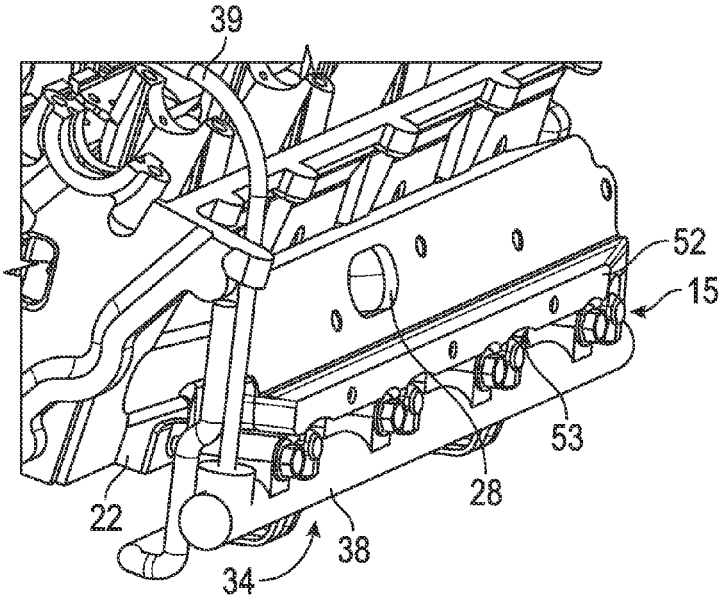
FIG. 3 is a schematic, fragmentary, perspective view of the internal combustion engine of FIG. 2, depicting the thermal barrier and a fuel injection system.
Figure 4:
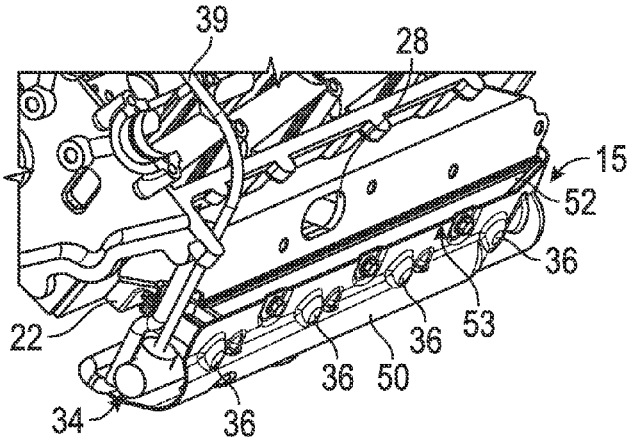
FIG. 4 is a schematic, fragmentary, perspective view of the internal combustion engine of FIG. 2, depicting the thermal barrier, the fuel injection system, and a heat shield disposed partly over the fuel injection system.

With reference to FIGS. 1 and 2, the engine assembly 15 further includes a fuel injection system 34 configured to inject fuel directly into the combustion chamber 18. In the depicted embodiment, the fuel injection system 34 includes at least one fuel injector 36 coupled to the exhaust side 24 of the cylinder head 22. The fuel injector 36 is disposed in fluid communication with the combustion chamber 18 and at least one fuel rail 38 carrying fuel F. A fuel pipe 39 (FIG. 3) may be fluidly coupled to the fuel rail 38 and, therefore, fuel F can flow from the fuel pipe 39 to the fuel rail 38. Further, the fuel F can flow from the fuel rail 38 to the fuel injector 36 and into the combustion chamber 18. The fuel injector 36 is at least partially disposed underneath the exhaust port 28 and the exhaust manifold 30.

With reference to FIGS. 2-5, the cylinder block 20 includes a plurality of cylinder block walls 40 that are part of the cylinder block 20, which define the combustion chamber 18. The cylinder block walls 40 are made of substantially rigid material, such as a rigid metal. For instance, the cylinder block walls 40 may be wholly or partly made of cast aluminum or cast iron. The internal combustion engine 14 defines at least one block cooling passageway 42, such as water jackets, extending through the cylinder block walls 40. The block cooling passageway 42 is enclosed by the cylinder block walls 40 and is configured, shaped, and sized to contain a coolant C in order to cool down the cylinder block 20. Accordingly, the coolant C flows through the block cooling passageway 42. As non-limiting examples, the coolant C may be water, a mixture of water and antifreeze, or any other fluid suitable to cool the cylinder block 20. Accordingly, the coolant C may also be referred to as a cooling fluid.

The cylinder head 22 also includes a plurality of cylinder head walls 44, which are made of a substantially rigid material, such as a rigid metal. For instance, the cylinder head walls 44 may be wholly or partly made of cast aluminum or cast iron. The cylinder head 22 defines one or more head cooling passageways 46 (e.g., water jackets) extending through the cylinder head walls 44. In the depicted embodiment, the cylinder head 22 has one head cooling passageway 46 at least partly disposed above the exhaust port 28 and another head cooling passageway 46 at least partly disposed below the exhaust port 28. However, the cylinder head 22 may include more or fewer head cooling passageways 46. Irrespective of the quantity, each head cooling passageway 46 is enclosed by the cylinder head walls 44 and is configured, shaped, and sized to receive the coolant C. The coolant C can flow through the head cooling passageways 44 in order to cool down the cylinder head 22. As discussed above, the coolant C may be water, a mixture of water and antifreeze, or any other fluid suitable to cool the cylinder head 22.

The vehicle 10 includes an exhaust manifold heat shield 48 for thermally insulating the exhaust manifold 30 from other components of the vehicle 10. The exhaust manifold heat shield 48 is at least partially disposed over the exhaust manifold 30 and is wholly or partly made of a thermal insulation material.

The vehicle 10 includes a fuel injection heat shield 50 for thermally insulating the fuel injection system 34 from other components of the vehicle 10. The fuel injection heat shield 50 is at least partially disposed over the fuel injection system 34 and is wholly or partly made of a thermal insulation material. The fuel injection heat shield 50 does not necessarily thermally isolate the fuel injection system 34 from the exhaust manifold 30 and the exhaust port 28. However, due to the location of the fuel injection system 34 relative to the exhaust port 28 and the exhaust manifold 30, heat may be transferred from the exhaust port 28 and the exhaust manifold 30 to the fuel injector 36 and the fuel rail 38. To maximize the efficiency of the internal combustion engine 14, it is useful to minimize the heat transfer between the exhaust port 28 and the exhaust manifold 30 and the fuel injector 36 and the fuel rail 38. To this end, the internal combustion engine 14 includes a head cooling extension 52 configured to minimize heat transfer from the exhaust port 28 and the exhaust manifold 30 to the fuel injector 36.

The head cooling extension 52 forms a protrusion in the exhaust side 24 of the cylinder 22 away from the combustion chamber 18 and is disposed between 1) the exhaust port 28 and the exhaust manifold 30 and 2) the fuel injector 36 and the fuel rail 38. The head cooling extension 52 includes at least one extension wall 54 made of a substantially rigid material, such as a cast metal. As non-limiting examples, the extension walls 54 may be wholly or partly made of cast iron or cast aluminum. Moreover, the extension walls 54 can be integrally formed with the cylinder head walls 44. Accordingly, the cylinder head walls 44 and the extension walls 54 are part of a unitary or one-piece structure. The head cooling extension 52 defines at least one extension cooling passageway 56, such as a water jacket, extending through extension walls 54. The extension cooling passageway 56 is at least partially enclosed by the extension walls 54 and is configured, shaped, and sized to contain the coolant C in order to cool down the head cooling extension 52. In the depicted embodiment, the extension coolant passageway 56 is collectively defined by the extension walls 54 and at least one of the exhaust port walls 27 of the exhaust port 28. Coolant C can flow through the extension cooling passageway 56. As discussed above, the coolant C may be water, a mixture of water and antifreeze, or any other fluid suitable to cool the head cooling extension 52. The extension cooling passageway 56 may be part of the head cooling passageways 46 and, therefore, the coolant C can flow from the head cooling passageways 46 to the extension cooling passageway 56 in order to thermally isolate the fuel injection system 34 from the heat stemming from the exhaust gases E flowing through the exhaust port 28 and the exhaust manifold 30. In other words, at least one of the head cooling passageways 46 may be in fluid communication with the extension cooling passageway 56. During operation of the internal combustion engine 14, the head cooling extension 52 serves as a thermal barrier 53 and thermally isolates the fuel injection system 34 from the hot exhaust gases E flowing through the exhaust port 28 and the exhaust manifold 30, thereby maintaining most of the surfaces surrounding the fuel injection system 34 relatively cool (i.e., at a temperature close to the temperature of the coolant C).

As discussed above, the extension walls 54 of the head cooling extension 52 are at least partly made of a substantially rigid material, such as cast iron or cast aluminum. Because the head cooling extension 52 is substantially rigid, it can absorb an external force applied to the vehicle 10 and thereby minimize the transfer of such external force to the fuel injection system 34. The head cooling extension 52 may have a substantially rectangular or square cross-section in order to maximize its structural integrity.

While the best modes for carrying out the teachings have been described in detail, those familiar with the art to which this disclosure relates will recognize various alternative designs and embodiments for practicing the teachings within the scope of the appended claims.

The invention claimed is:

1. An engine assembly, comprising: a cylinder block having at least one cylinder, wherein the at least one cylinder defines a combustion chamber: at least one cylinder head coupled to the cylinder block; at least one intake port coupled to the at least one cylinder head, wherein the at least one intake port is in fluid communication with the combustion chamber; at least one exhaust port coupled to the at least one cylinder head, wherein the at least one exhaust port is in fluid communication with the combustion chamber; at least one fuel injector coupled to the at least one cylinder head, wherein the at least one fuel injector is configured to inject fuel directly into the combustion chamber; a head cooling extension forming a protrusion in the at least one cylinder head, the head cooling extension including at least one extension wall and defining an extension cooling passageway at least partially enclosed by the at least one extension wall; wherein the extension cooling passageway is at least partly disposed between the at least one exhaust port and the at least one fuel injector in order to create a thermal barrier between the at least one fuel injector and the exhaust port when a coolant flows through the extension cooling passageway; and wherein the at least one cylinder head has an exhaust side and an intake side opposite to the exhaust side, the at least one intake port is coupled to the intake side of the at least one cylinder head, and the at least one exhaust port is coupled to the exhaust side of the at least one cylinder head, and the fuel injection system includes at least one fuel injector coupled to the exhaust side of the at least one cylinder head, and the at least one fuel injector is closer to the exhaust side than to the intake side of the at least one cylinder head.

2. The engine assembly of claim 1, wherein the head cooling extension forms a protrusion in the at least one cylinder head extending away from the combustion chamber.

3. The engine assembly of claim 1, wherein the at least one extension cooling passageway is partly disposed over the at least one fuel injector.

4. The engine assembly of claim 1, wherein the fuel injection system further includes at least one fuel rail configured to carry fuel, the fuel rail is in fluid communication with the at least one fuel injector, and the head cooling extension is at least partially disposed over the fuel rail.

5. The engine assembly of claim 4, wherein the at least one exhaust port is configured to be coupled to an exhaust manifold, and the extension cooling passageway is at least partially disposed between the exhaust manifold and the fuel rail.

6. The engine assembly of claim 5, wherein the at least one cylinder head includes a plurality of cylinder head walls and defines at least one head cooling passageway at least partially enclosed by the cylinder head walls, and the at least one head cooling passageway is configured to carry the coolant.

7. The engine assembly of claim 6, wherein the at least one head cooling passageway is in fluid communication with the extension cooling passageway.

8. The engine assembly of claim 1, wherein the at least one exhaust port includes at least one exhaust port wall, and the extension cooling passageway is defined by the at least one exhaust port wall and the at least one extension wall.

9. The engine assembly of claim 1, wherein the head cooling extension has a substantially rectangular cross-section.

10. A vehicle, comprising: a cylinder block having at least one cylinder, wherein the at least one cylinder defines a combustion chamber: at least one cylinder head coupled to the at least one cylinder block; at least one intake port coupled to the at least one cylinder head, wherein the at least one intake port is in fluid communication with the combustion chamber; at least one exhaust port coupled to the at least one cylinder head, wherein the at least one exhaust port is in fluid communication with the combustion chamber; an exhaust manifold coupled to the at least one exhaust port, wherein the exhaust manifold is in fluid communication with the at least one exhaust port; a fuel injection system coupled to the at least one cylinder head, wherein the fuel injection system is configured to inject fuel into the combustion chamber; a head cooling extension forming a protrusion in the at least one cylinder head, the head cooling extension including at least one extension wall and defining an extension cooling passageway at least partially enclosed by the at least one extension wall; wherein the head cooling extension is at least partly disposed between the fuel injection system and the exhaust manifold in order to create a thermal barrier between the fuel injection system and the exhaust manifold when a coolant flows through the extension cooling passageway; and wherein the at least one cylinder head has an exhaust side and an intake side opposite to the exhaust side, the at least one intake port is coupled to the intake side of the at least one cylinder head, and the at least one exhaust port is coupled to the exhaust side of the at least one cylinder head, and a fuel injection system includes the at least one fuel injector coupled to the exhaust side of the at least one cylinder head, and the at least one fuel injector is closer to the exhaust side than to the intake side of the at least one cylinder head.

11. The vehicle of claim 10, wherein the head cooling extension forms a protrusion in the at least one cylinder head extending away from the combustion chamber.

12. The vehicle of claim 10, wherein the at least one extension cooling passageway is partly disposed over the at least one fuel injector.

13. The vehicle of claim 12, wherein the fuel injection system further includes at least one fuel rail configured to carry fuel, the fuel rail is in fluid communication with the at least one fuel injector, and the head cooling extension is at least partially disposed over the fuel rail.

14. The vehicle of claim 13, wherein the extension cooling passageway is at least partially disposed between the exhaust manifold and the fuel rail.

15. The vehicle of claim 10, wherein the at least one cylinder head includes a plurality of cylinder head walls and defines at least one head cooling passageway at least partially enclosed by the cylinder head walls, and the at least one head cooling passageway is configured to carry the coolant.

16. The vehicle of claim 15, wherein the at least one head cooling passageway is in fluid communication with the extension cooling passageway.

17. The vehicle of claim 10, wherein the at least one exhaust port includes at least one exhaust port wall, and the extension cooling passageway is defined by the at least one exhaust port wall and the at least one extension wall.

18. The vehicle of claim 10, wherein the head cooling extension has a substantially rectangular cross-section.

* * * * *